US006602304B2

(12) United States Patent
Jung et al.

(10) Patent No.: US 6,602,304 B2
(45) Date of Patent: Aug. 5, 2003

(54) DYE-ACCELERANT COMPOSITION AND PROCESS FOR USING SAME

(76) Inventors: James Jung, 3171 W. Olympic Blvd. #704, Los Angeles, CA (US) 90006; Alex Kyuhun Lee, 5282 La Luna Dr., La Palma, CA (US) 90623; Yoon Gil Kim, 219 N. Serrano Ave., Los Angeles, CA (US) 90004

( * ) Notice: Subject to any disclaimer, the term of this patent is extended or adjusted under 35 U.S.C. 154(b) by 0 days.

(21) Appl. No.: 10/147,278

(22) Filed: May 15, 2002

(65) Prior Publication Data

US 2003/0005528 A1 Jan. 9, 2003

Related U.S. Application Data

(60) Provisional application No. 60/291,257, filed on May 16, 2001.

(51) Int. Cl.[7] ..... D06P 1/38; D06P 3/66

(52) U.S. Cl. ..... 8/543; 8/576; 8/594; 8/602; 8/611; 8/617; 8/930

(58) Field of Search ..... 8/400, 543, 516, 8/594, 602, 611, 617, 930

(56) References Cited

U.S. PATENT DOCUMENTS 3,807,872 A * 4/1974 Pronier
3,987,808 A * 10/1976 Carbonell et al.
5,152,802 A 10/1992 Berger et al.
5,389,305 A 2/1995 Repinec et al.
5,451,336 A 9/1995 Schwadtke et al.
5,972,876 A 10/1999 Robbins et al.
6,007,584 A 12/1999 Suzuki et al.
6,036,864 A 3/2000 Demyanovich
6,099,594 A 8/2000 Kummeler et al.
6,193,764 B1 * 2/2001 Herrera

* cited by examiner

*Primary Examiner*—Margaret Einsmann
(74) *Attorney, Agent, or Firm*—Christie, Parker & Hale, LLP

(57) ABSTRACT

A novel aqueous dye-accelerant composition that allows for the effective and rapid reaction of a dye with the fibers of a substrate such that the dye becomes evenly attached to the substrate within seconds is provided. The dye-accelerant composition generally comprises: an organic solvent; at least one dispersing agent; a chelating agent; and a vehicle. In another embodiment, a dyeing process utilizing the dye-accelerant composition, which includes five primary treatment processes: a pre-treatment process, a bleaching process, a neutralize and dye accelerant process, a dyeing process, and a dye stop or fixing process is provided.

7 Claims, 1 Drawing Sheet

DYE-ACCELERANT COMPOSITION AND PROCESS FOR USING SAME

CROSS-REFERENCE TO RELATED APPLICATIONS

This application is claims priority of provisional application No. 60/291,257, filed on May 16, 2001, contents of which are incorporated herein.

FIELD OF THE INVENTION

The present invention relates to the art of fabric dyeing and more particularly to a process for continuously dyeing long lengths of fabric. The present invention is also directed to a novel aqueous dye-accelerant composition for effectively and rapidly reacting a dye with the fibers of a textile substrate.

BACKGROUND OF THE INVENTION

Over the years four chief techniques have been developed to the application of applying dyes to textiles. In one case, the dye liquor is moved as the material is held stationary. In another case, the textile material is moved without mechanical movement of the liquor, such as, for example in a Beck dyeing machine. In another case, the textile material is moved along with the mechanical movement of the liquor. Finally, a substantially non-mechanical dyeing process has been developed which is typically referred to as exhaustion. However, these conventional methods of applying dyes have many disadvantages, including, the length of time required to dye and fix the dye in the fabric; and the discoloration or, more particularly, shade variation of the dye which can result by their use.

For example, continuous processes for dyeing fabrics with reactive, direct, vat or dispersive dyes by padding methods are established in the art as are discontinuous methods, such as the batchwise exhaustion method. However, both conventional continuous and semi-continuous methods for dyeing fabrics have distinct disadvantages with regard to the appearance of the dyed material, and the time required to complete the dyeing process. For instance, semi-continuous dyeing of fabrics with fiber-reactive dyes by the cold pad-batch method gives rise to crease marks due to the plaiting of the impregnated material in boxes, which greatly reduces the quality of the finished article.

In addition, the dyeing times and fixing times for both techniques are on the order of hours, making efficient dyehouse management very difficult. A further disadvantage of conventional dyeing processes is that they are environmentally harmful. For example, conventional cellulose reactive dyeing processes generate large amounts of highly colored effluents containing high concentrations of electrolyte (up to 100 g/l) and alkali.

Accordingly, a need exists for a method of dyeing fabric that rapidly, economically, ecologically and uniformly distributes a small amount of dye throughout the substrate with no required waiting period.

SUMMARY OF THE INVENTION

In an embodiment according to the present invention, a dye accelerant chemical, comprising a novel aqueous dye-accelerant composition is provided. The dye-accelerant composition comprising: an organic solvent; at least one dispersing agent; a chelating agent; and a vehicle.

In an alternative embodiment, the dye-accelerant composition comprises about 0.5 to 5% by weight of an organic solvent, about 10 to 20% by weight of at least one dispersing agent, about 0.5 to 10% by weight of a chelating agent; more preferably about 0.5 to 2% by weight of an organic solvent, about 10 to 20% by weight of at least one dispersing agent, about 0.5 to 5% by weight of a chelating agent, and about 50 to 99% by weight of a vehicle; and even more preferably about 1% by weight of an organic solvent, about 15% by weight of at least one dispersing agent, about 3% by weight of a chelating agent, and about 80% by weight of a vehicle.

In still another embodiment, the organic solvent is an organic compound having a low vapor pressure, such as a lower alcohol. In such an embodiment, the lower alcohol may be selected from the group consisting of: methanol, ethanol, propanol, isopropanol, butanol, and isobutanol.

In yet another embodiment, the dispersing agent is one or more surfactants selected from the group of: noionic, anionic, cationic, ampholytic, and zwitterionic surfactants. Preferably, the dispersing agent is one or more surfactants selected from the group consisting of: nonionic and anionic surfactants, and even more preferably the dispersing agent is a combination of both an anionic and nonionic surfactant. In such an embodiment, the composition comprises about 5 to 20% by weight of a nonionic surfactant and about 0.5 to 5% by weight of an anionic surfactant, more preferably about 10 to 15% by weight of a nonionic surfactant and about 0.5 to 2% by weight of an anionic surfactant, and even more preferably about 13% by weight of a nonionic surfactant and about 1% by weight of an anionic surfactant. In such an embodiment, the dispersing agent may be selected from the group consisting of: carboxymethylcellulose, hydroxypropylcellulose, alkyl aryl sulphonates, long-chain alcohol sulphates (primary and secondary alkyl sulphates), sodium sulphates, sodium alkyl sulphates, sodium aryl sulphates, sulphonated olefins, sulphated monoglycerides, sulphated ethers, sulphosuccinates, sulphonated methyl ethers, alkane sulphonates, phosphate esters, alkyl isethionates, acyl sarcosides, alkyl taurides, fluorosurfactants, fatty alcohol and alkyl phenol condensates, fatty acid condensates, condensates of ethylene oxide with an amide, condensates of ethylene oxide with an amide, block polymers (polyethylene glycol, polypropylene glycol, ethylene diamine condensed with ethylene or propylene oxide), sucrose esters, sorbitan esters, alkylomides, ethoxylated amine polymers and mixtures thereof. In a preferred embodiment, the dispersing agent is a combination of an alkyl phenol ethoxylate and a sodium alkyl sulphate, and in an even more preferred embodiment the dispersing agent is a combination of nonylphenolethoxylate and sodium naphtalene sulphate.

In still yet another embodiment, the chelating agent is selected from the group consisting of: aminocarboxylic acids, hydroxyaminocarboxylic acids, hydroxycarboxylic acids, phosphates, di-phosphates, tri-phosphates, higher poly-phosphates, pyrophosphates, zeolites, polycarboxylic acids, carbohydrates (polysaccharides), hydroxypyridinones, organic compounds comprising catechol groups, organic compounds comprising hydroxymate groups, silicates or polyhydroxysulfonates. In such an embodiment, the chelating agent may be selected from the group consisting of: EDTA (ethylene diamine tetra-acetic acid), DTPA (Diethylene triamine pentaacetic acid), NTA (nitrilo triacetic acid), HEDTA (hydroxyethylene diamine tetra-acetic acid), DEG/DHEG (dihydroxyethyl glycine), HEIDA (N-(2-hydroxyethyl)-iminodiacetat), gluconic acid, citric acid, tartaric acid, oxalic acid, diglycolic acid, PBTC (phosphonobutantriacetat), ATMP (aminotri (methylenphosphonic acid), DTPMP (diethylene triaminpenta(methylenphosphonic acid), maleic acid, itaconic acid, mesaconic acid, fumaric acid, aconitic acid, and citraconic acid.

In still yet another preferred embodiment, the vehicle is water.

In still yet another embodiment, the composition further comprises an electrolytic salt. In such an embodiment, the electrolytic salt may be a combination of caustic soda and sodium bicarbonate.

In still yet another embodiment, the dye-accelerant composition comprises: about 1% by weight of isopropyl alcohol; about 13% by weight of alkyl phenol ethoxylate; about 1% by weight of sodium alkyl sulphate; about 3% by weight of DTPA; and about 80% by weight of water.

In still yet another embodiment, a dyeing process utilizing the dye-accelerant composition is provided, which includes five primary treatment processes: a pre-treatment process, a bleaching process, a neutralize and dye accelerant process, a dyeing process, and a dye stop or fixing process.

In still yet another embodiment, the concentration of dye accelerant used in the dyeing process is maintained at a specified percent automatically. In such an embodiment the mechanism for automatically controlling the percent concentration of dye-accelerant utilized in the process may include an automatic injection apparatus linked in a feedback system to a quantitative dye-accelerant analysis apparatus.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
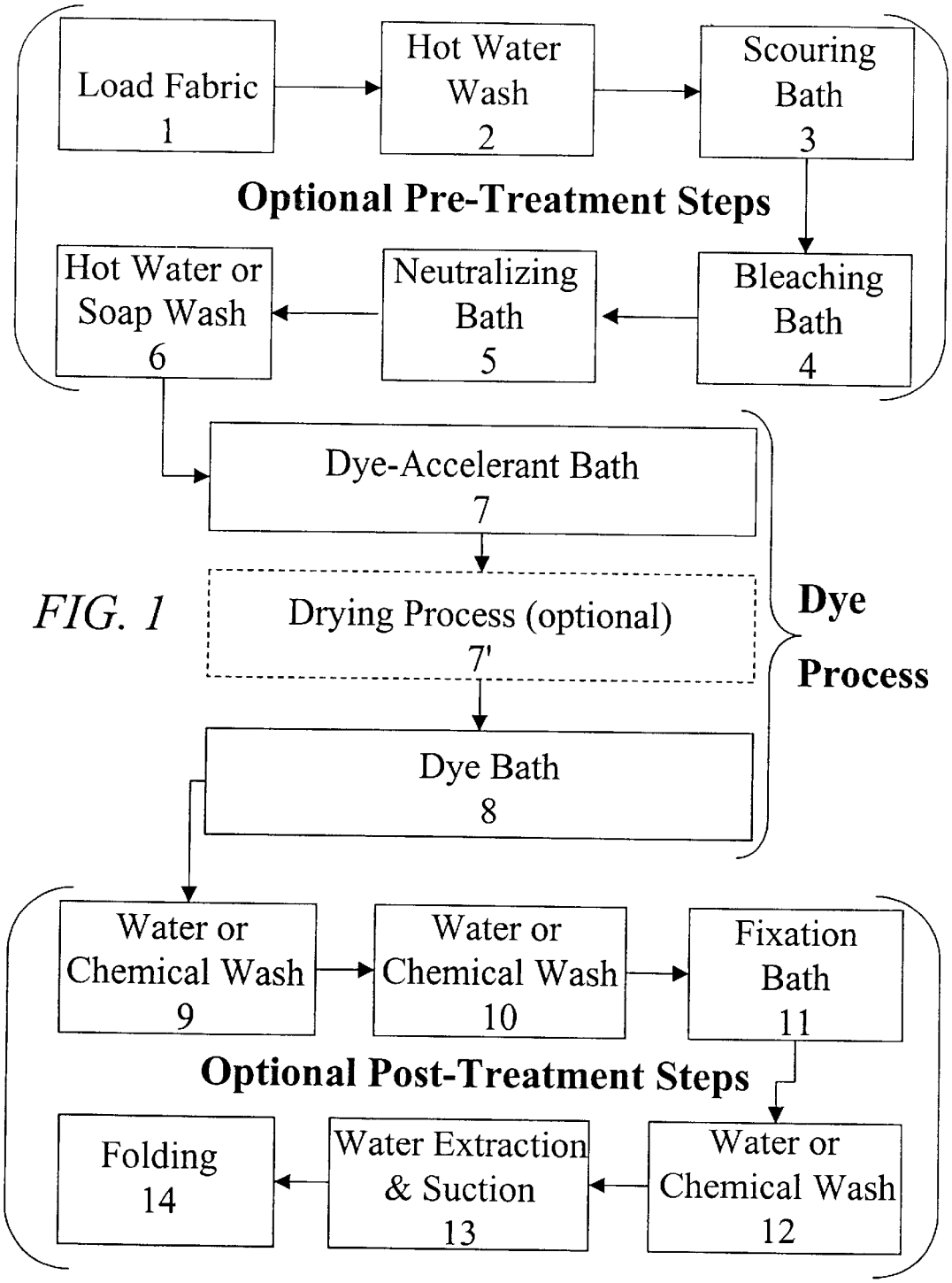
FIG. 1 is a flow-chart representation of a continuous dyeing process utilizing the dye-accelerant composition in an embodiment according to the present invention.

The present invention is directed to a dye-accelerant composition that allows for the effective and rapid reaction of a dye with the fibers of a substrate such that the dye becomes evenly attached to the substrate within seconds. Accordingly, a novel aqueous dye-accelerant composition ("TC1") for rapidly reacting the dye with the fibers of the cloth is provided. TC1 is the product name given to the novel aqueous dye-accelerant composition (dye accelerant chemical) by TND Trading, Inc., Los Angeles, Calif., the composition and manufacture of which is described below.

In one embodiment, the dye-accelerant composition generally comprises:

an organic solvent;

at least one dispersing agent;

a chelating agent; and a vehicle.

Although any combination of the above components suitable for forming a dye-accelerant composition according to the present invention can be utilized, preferably the dye-accelerant composition comprises: from about 0.5% to about 5% by weight of an organic solvent; from about 10% to about 20% by weight of at least one dispersing agent; from about 1% to about 5% by weight of a chelating agent based on the weight of the total solution; and a sufficient quantity of water to make the solution aqueous. More preferably, the dye-accelerant composition comprises: about 1% by weight of an organic solvent; about 15% of at least one dispersing agent; about 3% of a chelating agent and about 80% of a vehicle by weight.

In the dye-accelerant composition of the present invention, any suitable organic solvent may be utilized such that a dilute mixture of a solvent and the vehicle is created. The preferred solvents are organic compounds having relatively low vapor pressures, such as lower alcohols, such as, for example, methyl, ethyl, propyl, isopropyl, butyl and isobutyl alcohols. However, any suitable organic solvent may be utilized. Generally, about 0.5 to 5% by weight solution or dispersion of the solvent is prepared, more preferably about 0.5 to 2% by weight solution or dispersion, and even more preferably about a 1% by weight solution or dispersion of the organic solvent is prepared.

It has been experimentally established that more favorable dye application results are obtained in the process of the present invention when the dye-accelerant composition additionally comprises at least one dispersing agent. Any suitable dispersing agent may be selected from the group of nonionic, anionic, cationic, ampholytic or zwitterionic surfactants or a combination thereof. More preferably, the dispersing agent is either a nonionic or anionic surfactant or a combination thereof. Even more preferably the dispersing agent comprises both an anionic and nonionic surfactant.

For example, the dispersing agent may be selected from suitable surfactants, including: carboxymethylcellulose, hydroxypropylcellulose, alkyl aryl sulphonates, long-chain alcohol sulphates (primary and secondary alkyl sulphates), sodium sulphates, sodium alkyl sulphates, sodium aryl sulphates, sulphonated olefins, sulphated monoglycerides, sulphated ethers, sulphosuccinates, sulphonated methyl ethers, alkane sulphonates, phosphate esters, alkyl isethionates, acyl sarcosides, alkyl taurides, fluorosurfactants, fatty alcohol and alkyl phenol condensates, fatty acid condensates, condensates of ethylene oxide with an amide, condensates of ethylene oxide with an amide, block polymers (polyethylene glycol, polypropylene glycol, ethylene diamine condensed with ethylene or propylene oxide), sucrose esters, sorbitan esters, alkylomides, ethoxylated amine polymers and mixtures thereof. Generally about 15% of the dye-accelerant composition by weight solution comprises the at least one dispersing agent.

In a particular embodiment of the present invention, the dispersing agent comprises a mixture of a nonionic surfactant, such as an alkyl phenol ethoxylate; and an anionic surfactant, such as a sodium aryl sulphate. Specifically, in one preferred embodiment, the nonionic surfactant is an alkyl phenol ethoxylate, such as a nonylphenol ethoxylate (T-Det-9.5 from Huntsman Chemical Corp. or PolyTergent B-300 from Olin Corp); and the anionic surfactant is a sodium aryl sulphate, such as sodium napthalene sulphate (TCT 90P or TCL 92P from UFAROL). In such an embodiment, generally about 15% of the dye-accelerant composition by weight solution comprises the dispersing agent, more preferably about 5 to 20% by weight solution is a nonionic surfactant and about 0.5 to 5% by weight solution is an anionic surfactant. Even more preferably, about 10 to 15% by weight solution of the dye-accelerant composition is a nonionic surfactant and 0.5 to 2% is an anionic surfactant. Still more preferably, about 13% by weight solution is a nonionic surfactant and 1% is an anionic surfactant.

It has also been experimentally established that more favorable dye application results are obtained in the process of the present invention when the dye-accelerant composition additionally comprises a chelating agent. Any suitable chelating agent may be selected such that the chelating agent is soluble and capable of forming complexes with di- or trivalent cations (such as calcium) at acidic, neutral or alkaline pH values.

For example, the chelating agent may be suitably selected from materials, including: aminocarboxylic acids, hydroxyaminocarboxylic acids, hydroxycarboxylic acids, phosphates, di-phosphates, tri-phosphates, higher polyphosphates, pyrophosphates, zeolites, polycarboxylic acids, carbohydrates (polysaccharides), hydroxypyridinones, organic compounds comprising catechol groups, organic compounds comprising hydroxymate groups, silicates or polyhydroxysulfonates.

For example, when the chelating agent is an aminocarboxylic acid, it may suitably be selected from agents including: EDTA (ethylene diamine tetra-acetic acid), DTPA (Diethylene triamine pentaacetic acid), NTA (nitrilo triacetic acid), etc. When the chelating agent is a hydroxyamincarboxylic acid it may be suitably selected from agents including: HEDTA (hydroxyethylene diamine tetra-acetic acid), DEG/DHEG (dihydroxyethyl glycine), HEIDA (N-(2-hydroxyethyl)-iminodiacetat), etc. When the chelating agent is a hydroxy carboxylic acid, it may be suitably selected from agents including: gluconic acid, citric acid, tartaric acid, oxalic acid, diglycolic acid, etc. When the chelating agent is a polyamino- or polyhydroxyphosphonate or polyphosphonate, it may be suitably selected from agents including: PBTC phosphonobutantriacetat), ATMP (aminotri(methylenphosphonic acid), DTPMP (diethylene triaminpenta(methylenphosphonic acid), etc. When the chelating agent is a polycarboxylic acid (or a mixture of polycarboxylic acids), it may suitably be selected from agents including: water soluble salts of homo- and copolymers of aliphatic carboxylic acids such as maleic acid, itaconic acid, mesaconic acid, fumaric acid, aconitic acid, citraconic acid, etc.

The choice of chelating agent depends on pH of the solution, and therefore on the choice of dye and substrate utilized. Generally, about 3% of the dye-accelerant composition by weight solution comprises the chelating agent. More preferably about 0.5 to 10% by weight solution is a chelating agent. Even more preferably about 0.5 to 5% by weight solution is a chelating agent. Still more preferably about 1 to 3% by weight solution is a chelating agent.

In a particular embodiment of the present invention, the chelating agent is an aminocarboxylic acid, such as EDTA or DTPA. Specifically, in one preferred embodiment the chelating agent is DTPA. In such an embodiment, preferably about 3% by weight of the dye-accelerant composition is DTPA.

In addition, any suitable vehicle can be utilized in the current composition. Preferably the vehicle is water. In such an embodiment, the water can be additionally conditioned as suitable, such as, distilled, degassed, or otherwise purified. Generally, about 80% of the dye-accelerant composition by weight solution is vehicle. More preferably about 50 to 99% by weight solution is vehicle. Even more preferably about a 70 to 90% by weight solution is vehicle. Still more preferably about 80 to 90% by weight solution is vehicle.

In accordance with the above disclosure, a preferred dye-accelerant composition for conditioning an undyed substrate for dyeing in accordance with this invention comprises:

about 1% by weight of an organic solvent;

about 15% by weight of a surfactant;

about 3% by weight of a chelating agent; and about 80% by weight of a vehicle.

More preferably, the dye-accelerant composition for a dyed substrate in accordance with this invention comprises:

about 1% by weight of an alcohol-based organic solvent;

about 15% by weight of a mixture of nonionic and anionic surfactants, comprising about 13% by weight of a nonionic surfactant and about 1% by weight of an anionic surfactant;

about 3% by weight of a aminocarboxylic acid chelating agent; and about 80% by weight of a vehicle.

Most preferably, the dye-accelerant composition for a dyed substrate in accordance with this invention comprises:

about 1% by weight of isopropyl alcohol;

about 15% by weight of a mixture of nonionic and anionic surfactants, comprising about 13% of alkyl phenol ethoxylate and about 1% of sodium alkyl sulphate;

about 3% of DTPA; and about 80% water.

In all of the above embodiments, a further electrolytic salt is included in the solution to maintain the dye-accelerant solution at an alkaline pH. Any suitable electrolytic salt can be utilized, but preferably the electrolytic salt is either a caustic soda or sodium bicoarbonate. Any suitable amount of electrolytic salt can be used such that the solution is maintained at an alkaline pH.

The dye-accelerant solution of the current invention may be used with any suitable dyeing process. As described above, in the application of dyes, four chief techniques have been developed to the application of dyes to textiles. In one case, the dye liquor is moved as the material is held stationary. In another case, the textile material is moved without mechanical movement of the liquor, such as, for example in a Beck dyeing machine.

Examples of the foregoing include jig dyeing and continuous dyeing, which involves the padding of the fabric. A combination of the two is exemplified by a Klauder-Weldon skein-dye machine, in which the dye liquor is pumped as the skeins are mechanically turned. Another example is a jet or spray dyeing machine, in which both the goods and the liquor are constantly moving.

Finally, a dyeing process which can be substantially non-mechanical is typically referred to as exhaustion. This process involves the preparation of a dye bath containing an aqueous solution, usually water, and the dye. The textile to be dyed is then inserted into the dye bath. The temperature of the dye bath is then raised to a predetermined optimal level with the pH of the bath being similarly maintained, and the textile material is then soaked in the bath.

Any of the above various methods can be employed to apply either the dye-accelerant composition or the dye or both onto the substrate. For example, the dye-accelerant composition and dye can be applied by means of a process known as exhaustion. In exhaust dyeing, the contact between the substrate and the solution is achieved by one of the following ways: (1) the solution is circulated continuously by a pump through the substrate that remains stationary, or (2) the substrate is circulated through the stationary solution, or (3) both are in continuous movement, i.e., while the solution is circulated, the substrate is in constant movement. Regardless of the particular exhaust method employed, the dye-accelerant composition and the dye are placed in separate aqueous baths, after which the temperature of the baths are raised and maintained at an optimal level. The substrate fabric is then placed in the dye-accelerant bath and soaked for a predetermined amount of time. While the substrate soaks in the bath, the dye-accelerant becomes absorbed by the fibers of the substrate. Then the fabric is moved to the dye bath and the process is repeated.

Another method of applying the dye-accelerant composition and/or dye is known as a padding operation whereby the dye-accelerant is padded or blotted onto the substrate. This operation is very similar to that of the continuous dyeing operation since the substrate is mechanically carried into and out of the padding apparatus.

The dye-accelerant composition and/or dye can also be applied onto the substrate by other methods well known in the art such as by jet spraying. Spray applicators such as those available from Otting International can be employed to spray the dye-accelerant onto the substrate. It should be noted, however, that the substrate can be treated with the dye-accelerant composition in any known manner without departing from the spirit of the invention, so long as contacting the fabric substrate with the disclosed dye-accelerant composition prior to contacting the dye itself is performed.

In a preferred embodiment, the dye-accelerant composition and/or dye is applied by a method similar to that of the continuous dyeing operation disclosed herein. According to this method, the fabric substrate travels along rollers into and out of several baths.

Regardless of the method used, in the present embodiment of the invention, preferably undyed textile substrates are contacted with the composition of the invention. The undyed textile is contacted with an aqueous solution or dispersion of the dye-accelerant composition of the invention. The dye-accelerant composition of the invention is added to the aqueous solution in an amount to provide from about 1 to about 10 percent by weight of the composition of the textile being treated. The undyed textile is contacted for a sufficient length of time to evenly impregnate the textile with the composition such that the dye rapidly reacts with the fabric substrate.

The amount of the dye-accelerant composition used should be sufficient to provide fast reaction of the dye with the substrate. The types of substrates which will be treated with the dye-application composition will vary as will the concentration of dye-accelerant composition required. As noted above, generally the dye-accelerant composition is applied to the fabric from an aqueous bath continuous-dyeing method.

Any mechanism could be utilized to maintain the concentration of dye-accerelant at the desired level including: regular manual measurements, timed injection of specified aliquots of dye-accelerant, etc. In one preferred embodiment of the invention, the concentration of dye-accelerant composition used is automatically maintained by linking an automatic injector in a continuous feedback loop to a device capable of quantitatively measuring the concentration of dye-accelerant in solution. For example, an injection valve could be connected in fluid communication with a reservoir of dye-accelerant and in signal communication with a spectral photometer, or other suitable analytical technique capable of measuring the concentration of dye-accelerant in solution. In such an embodiment, when the spectral photometer measures a concentration of dye-accelerant below a critical value, a signal would be sent to the dye-accelerant injector to inject an additional aliquot of dye-accelerant into solution. Using such a feedback system, the concentration of dye-accelerant in solution at any time could be maintained at an optimal level.

In most dye applications, the pH and temperature of the dye bath would also have to be sensitively controlled within a fairly narrow range. It should also be noted that in these conventional techniques the pH and temperature ranges are dependent on many variables including both the type of fabric substrate being treated and the type of dyestuff being fixed. In the current invention, it has been found that the only pH requirement is that the solution remain generally alkaline, this reduces the need for pH controlled processes and significantly simplifies the dyeing process. Likewise, in conventional dyeing techniques the temperature of the dye bath is determined by the specific dye being used. In the current invention it has been found that the dye-accelerant composition allows for the application of any dye at any temperature between about 40° C. and 95° C. The temperature of the aqueous application-composition bath is preferably equal to or greater than about 80° C. and more preferably between about 80° C. to 95° C.

Dyeing describes the imprintation of a new and often permanent color, especially by impregnating with a dye, and is generally used in connection with textiles, paper, and leather. Dyes are intensely colored substances used for the coloration of various substrates, including paper, leather, fur, hair, foods, drugs, cosmetics, plastics, and textile materials. Dyes are retained in these substrates by physical adsorption, salt or metal-complex formation, solution, mechanical retention, or by the formation of covalent bonds. In the present invention, any suitable acid, direct or fiber-reactive dye may be utilized.

For example, dyes which can be used in the dyeing process of the present invention include all water-soluble dyes, especially those which are anionic in nature. Dyes having anionic, i.e., acidic, water-solubilizing groups are, for example, acid and direct dyes, such as, C.I. Acid Black 27 (C.I. No. 26 310), C.I. Acid Black 35 (C.I. No. 26 320), C.I. Acid Blue 113 (C.I. No. 26 360), C.I. Direct Orange 49 (C.I. No. 29 050), C.I. Direct Orange 69 (C.I. No. 29 055), C.I. Direct Yellow 34 (C.I. No. 29 060), C.I. Direct Red 79 (C.I. No. 29 065), C.I. Direct Yellow 67 (C.I. No. 29 080), C.I. Direct Brown 126 (C.I. No. 29 085), C.I. Direct Red 84 (C.I. No. 35 760), C.I. Direct Red 80 (C.I. No. 35 780), C.I. Direct Red 194 (C.I. No. 35 785), C.I. Direct Red 81 (C.I. No. 28 160), C.I. Direct Red 32 (C.I. No. 35 790), C.I. Direct Blue 162 (C.I. No. 35 770), C.I. Direct Blue 159 (C.I. No. 35 775), C.I. Direct Black 162:1 and C.I. Direct Violet 9 (C.I. No. 27 885).

However, the process of the present invention is also useful for dyeing with fiber-reactive dyes. Fiber-reactive dyes which may be particularly advantageous are those where the fiber-reactive radical is a radical of the vinyl sulfone series, for example, vinylsulfonyl or an ethylsulfonyl group which is substituted by an alkali-eliminable substituent in the β-position, such as, β-sulfatoethylsulfonyl, β-acetoxyethylsulfonyl, β-chloroethylsulfonyl or β-thiosulfatoethylsulfonyl; also fiber-reactive radicals of the chlorotriazinyl, fluorotriazinyl, fluoropyrimidinyl and chlorofluoropyrimidinyl series; and finally, also dyes possessing combinations of such reactive groups.

The abovementioned dyes useful for the dyeing process of the present invention are extensively described in the literature and well known to the person of ordinary skill in the art. For example, fiber-reactive dyes are described in the patent specifications mentioned above, and also in European patent application publication No. 0 513 656.

Likewise, the dye-acclerant solution of the present application may be utilized on any suitable cellulosic textile substrate. The most common types of cellulosic fibers are, for example, the natural fiber materials: cotton, jute and linen; and the modified fiber materials produced from cellulosic natural materials. Examples of modified fiber materials include: regenerated cellulose, for example filament viscose and rayon; and cellulose fibers modified with amino-containing compounds, as are known for example from U.S. Pat. No. 5,507,840, containing compounds, as are known for example from U.S. Pat. Nos. 5,507,840, 5,565,007 and 5,529,585, from European patent application publication No. 0 665 311 and from German Offenlegungsschrift 19 519 023. Carboxamido-containing fiber materials, which are natural fiber materials, such as wool and other animal hairs may also be utilized. The cellulosic fiber material can also be a blend of more than one type of cellulosic fiber.

The textile itself can be a woven (including knitted) or non-woven textile, but will usually be a clothing textile material.

The production of dyeings of acceptable quality requires the use of many auxiliary products and chemicals. Any of these conventional auxiliary products may be used with the current solution. These auxiliary chemicals include: materials that improve fastness properties such as bleaching agents, wetting and penetrating agents, leveling and retarding agents, fixing agents, and lubricating agents. Other agents are used to speed the dyeing process or for dispersion, oxidation, reduction, or removal of dyes from poorly dyed textiles. Generally, dyes are dissolved or dispersed in a liquid medium before being applied to a substrate where they are fixed by chemical or physical means, or both. Owing to its suitability, its availability, and its economy, water usually is the medium used in dye application; however, nonaqueous solvents have been used. The dye-accelerant composition can also be used in conjunction with other conventional finishing agents/additives such as softeners, leveling agents and the like. These can be added to the bath together with the dye-accelerant composition.

The current solution can also be utilized with any suitable drying method. For example, drying has previously been done either gradually, and/or catalyzed by a chemical migration inhibiting agent applied to the substrate. Either such method for inhibiting migration may be utilized in association with the dye-accelerant solution of the current invention.

The following non-limiting example serves to illustrate the invention. In the following examples all ratios are by weight, and percentages are weight percentages unless otherwise indicated.

Preparation of Dye-accelerant Compositions

EXAMPLE A

In one embodiment of the invention, an aqueous dye-accelerant solution according to the invention was made by mixing the following components at room temperature, followed by conventional mixing:

TABLE 1

Chemical Composition of Example A

| Fractional Composition | Compound |
|---|---|
| 0.111 | Isopropyl Alcohol |
| 0.133 | Nonyl phenol Ethanol |
| 0.008 | Sodium Napthalene Sulphate |
| 0.033 | Diethylenetriaminepentacetic acid |
| 0.813 | filtered water |

This compound was then used to conduct tests on the time required to apply both direct and fiber-reactive dyes.

This invention is also directed to a process for utilizing the dye-accelerant composition of the invention to continuously dye fabrics.

In one embodiment of the invention, shown schematically in FIG. 1, the continuous dyeing process of the present invention comprises five primary treatment processes: the pre-treatment process, the bleaching process, the neutralize and dye accelerant process, the dyeing process, and the dye stop or fixing process. With reference to FIG. 1, each primary process includes several steps which will be discussed in greater detail below.

I. The Pre-Treatment Process

Steps 1–3 are part of the raw fabric pre-treatment process, which occurs prior to bleaching the fabric. In step 1, raw fabric is loaded or fed into the continuous dyeing machine. In step 2, the raw fabric is soaked in a hot water wash. The hot water soak thoroughly wets the fabric and allows the fabric to more readily absorb the chemicals used in subsequent steps of the process. In step 3, the fabric is soaked in a chemical bath which contains scouring agents to remove dirt, wax, or other particulate matter from the fabric. After the scouring bath, the fabric may be run through an optional a hot water or soap bath to remove all traces of the scouring agent in preparation for bleaching the fabric.

II. Bleaching Process

In step 4, the pre-treated fabric is introduced into a bleaching solution which typically comprises a soluble mixture of hydrogen-peroxide and caustic soda. The fabric remains in the bleaching solution for period of about 15 minutes. The time period for bleaching may vary depending on the type and quality of the fabric being bleached. Depending on the fabric type, the bleaching solution is maintained at a temperature within a range with 98° C. being typical for most fabrics.

III. Neutralize and Pre-Treat Before Dyeing

In step 5, the fabric is introduced into a neutralizing solution. The solution typically consists of a mildly acidic solution and a hydrogen-peroxide neutralizer. Neutralizing hydrogen peroxide is required because any hydrogen-peroxide left on the fabric will prevent the dye-stop solution, used later in the process, from penetrating the fabric fibers and will consequently lead to dye or color bleeding from the finished product. The temperature of the neutralizing solution is typically not critical. After the neutralizing bath, in step 6, the fabric is run through a hot water or soap bath to remove all traces of the neutralizing agent in preparation for dyeing the fabric.

In step 7, the neutralized fabric is introduced into a solution of the dye-accelerant (discussed above) and caustic soda. In conventional fabric dyeing, the fabric is held in a dyeing tank for approximately two to four hours. This long dyeing time is the primary limitation on the production capacity of conventional dyeing facilities.

In the dyeing process of the present invention, the textile substrate is initially impregnated with the aqueous dye-accelerant solution according to the invention and then the dye of choice is applied. Accordingly, in the fabric dyeing system in an embodiment according to the present invention, fabric dyeing time is reduced to about 15–40 seconds by the application of the dye-acclerant and caustic soda solution. Any concentration of the aqueous dye-accelerant solution of the present invention may be utilized in this step such that the fabric has improved dye receptivity properties. Such concentration can be maintained by any suitable means, such as, by the feedback loop control system described above. More particularly, dyes are applied to any suitable substrate by first contacting the undyed substrate with a dye-accelerant composition of sufficient amount and having a suitable solubility and molecular weight comprising:

an organic solvent;

at least one dispersing agent;

a chelating agent; and a vehicle.

The dyeing accelerant allows the dye-stuff to quickly and evenly penetrate the fabric fibers. The fabric preferably is allowed to absorb (soak in) the dye-accelerant for a period generally between one to ten minutes. Any suitable mechanical means may be utilized in the dyeing process of the present invention to provide the absorption time (soak time) without interrupting the continuous operation of the machine, e.g., a J-box.

In an optional step (7'), the treated fabric is also dried prior to introduction into the dye bath. Any suitable drying process may be utilized, such as, for example, heat drying or compression drying.

IV. Dyeing Process

After the dyeing pre-treatment process, the fabric is introduced into the dyeing tank, step 8. Generally, the fabric will remain in the dyeing tank for about 10 seconds to about 2 minutes. Numerous factors affect the dyeing time. The most important factors are the feed rate of the machine, the desired color, and the type of fabric being dyed. Typically, the dye solution is maintained at a temperature of about 85 to 90° C. Dyeing solutions are well known in the art and may be obtained in both powder and liquid forms.

Although only a continuous dyeing process is described above, the dye-accelerant composition of the present invention may also be applied to conventional dyeing processes, such as, for example, cold patch dyeing (batch dyeing), pad dyeing, jet circular dyeing, and the like, to reduce dyeing time greatly. For example, application of the dye-accelerant may reduce the time required for jet circular dyeing from more than one hour to about 10 to 20 minutes.

Use of the dye-accelerant may also result in reduction of dye stuff and other auxiliary dyeing chemicals consumed during the dyeing process. For example, application of a dye-accelerant may result in a reduction of about 30–40% of dyeing stuff and the elimination of the need for soda ash, salt and/or sodium sulfate in the dye process.

V. Wash and Fix Process

The final steps in the dyeing process involve washing and fixing the dye-stuff in the fabric. After step 8, the fabric exits the dyeing tank and enters a water or chemical wash solution which contains an agent which removes particulates of dye-stuff which may remain on the fabric, step 9. In step 11, the washed fabric is soaked in a fixing solution which fixes the dye into the fabric and stops any further dyeing action. After step 11, the fixed fabric is soaked in a plain water or chemical wash to remove residual fixing solution, step 12. In step 13, the water and other liquid material is extracted from the fabric via compression and suction to at least partially dry the fabric. In a final step 14, the dyeing machine folds the finished fabric. It may occasionally, prove desirable with some dye-stuffs to use a second water or chemical wash after step 10. This optional wash is depicted as step 11 in FIG. 1.

Although limited embodiments of the dye-accelerant composition and the related dyeing process have been specifically described and illustrated herein, many modifications and variations will be apparent to those skilled in the art. Accordingly, it is to be understood that, within the scope of the appended claims, the dye-accelerant and its related process according to principles of this invention may be embodied other than as specifically described herein.

What is claimed is:

1. A process for dyeing fibers comprising: impregnating a fiber with an aqueous dye-accelerant solution comprising:

about 1% by weight of isopropyl alcohol, about 13% by weight of alkyl phenol ethoxylate, about 1% by weight of sodium aryl sulphate, about 3% by weight of DTPA, and about 80% by weight of water; and then applying a dye.

2. The process as described in claim 1 wherein the dye-accelerant composition is provided in an aqueous solution at a concentration from about 1 to 10% by weight of the textile being treated.

3. The process as described in claim 2, wherein the dye is a water-soluble dye.

4. The process as described in claim 1 further comprising automatically maintaining the concentration of dye-accelerant.

5. A process as described in claim 4, wherein the step of automatically maintaining comprises:

measuring the concentration of dye-accelerant; and automatically adjusting the quantity of dye-accelerant.

6. The process as described in claim 5, wherein the step of measuring involves spectroscopically analyzing the concentration of dye-accelerant in solution.

7. The process as described in claim 2, wherein the dye is a fiber-reactive dye.

* * * * *

UNITED STATES PATENT AND TRADEMARK OFFICE

CERTIFICATE OF CORRECTION

PATENT NO. : 6,602,304 B2
DATED : August 5, 2003
INVENTOR(S) : Jung et al.

It is certified that error appears in the above-identified patent and that said Letters Patent is hereby corrected as shown below:

Title page,
Item [76], Inventors, delete "Alex Kyuhun Lee, 5282 La Luna Dr., La Palma, CA (US) 90623;"

Signed and Sealed this

Seventeenth Day of February, 2004

JON W. DUDAS
*Acting Director of the United States Patent and Trademark Office*